US006452319B1

(12) United States Patent
Kwon et al.

(10) Patent No.: US 6,452,319 B1
(45) Date of Patent: Sep. 17, 2002

(54) ELECTRODE UNIT OF ELECTRON GUN FOR COLOR CATHODE RAY TUBE

(75) Inventors: Yong-geol Kwon; Young-gon Hong; Kyung-ho Kim, all of Suwon; Kwang-jin Yoon, Kunpo; Deok-ho Kim, Suwon, all of (KR)

(73) Assignee: Samsung SDI Co., LTD, Kyungki-Do (KR)

( * ) Notice: Subject to any disclaimer, the term of this patent is extended or adjusted under 35 U.S.C. 154(b) by 0 days.

(21) Appl. No.: 09/513,769

(22) Filed: Feb. 25, 2000

(30) Foreign Application Priority Data

Mar. 11, 1999 (KR) ..... 99-8076

(51) Int. Cl.[7] ..... H01J 29/56
(52) U.S. Cl. ..... 313/414; 313/409; 313/460
(58) Field of Search ..... 313/414, 460, 313/409, 412, 413, 449, 458

(56) References Cited

U.S. PATENT DOCUMENTS 4,370,592 A 1/1983 Hughes et al. ..... 313/414
4,583,024 A * 4/1986 Chen ..... 313/414
4,626,738 A 12/1986 Gerlach ..... 313/414
5,414,323 A 5/1995 Uchhida et al. ..... 313/414

* cited by examiner

*Primary Examiner*—Vip Patel
*Assistant Examiner*—Ken A Berck
(74) *Attorney, Agent, or Firm*—Leydig Voit & Mayer, Ltd.

(57) ABSTRACT

An electrode unit of an electron gun for a cathode ray tube including an outer rim electrode having a large-diameter electron beam passing hole through which three electron beams pass, and an inner electrode installed within the outer rim electrode and having a central electron beam passing hole disposed at its center and side electron beam passing holes disposed at opposite sides of the central electron beam passing hole. The side electron beam passing holes each have first and second curved sides along the sides closest to the central electron beam passing hole and opposite those sides, and linear portions connecting the first and second curved portions. The vertical and horizontal dimensions of the side electron beam passing holes are equal to each other.

7 Claims, 4 Drawing Sheets

ELECTRODE UNIT OF ELECTRON GUN FOR COLOR CATHODE RAY TUBE

BACKGROUND OF THE INVENTION

1. Field of the Invention

The present invention relates to an electron gun for a color cathode ray tube, and more particularly, to an electrode unit of an electron gun for a color cathode ray tube, for forming a large-diameter electronic lens.

2. Description of the Related Art

In a general electron gun for a color cathode ray tube, spherical aberration and focusing characteristics are greatly affected by a main lens. Thus, in order to obtain good focusing characteristics, the spherical diameter of the main lens must be increased.

However, in an in-line electron gun, since three electron beam passing holes are formed at at least two electrodes constituting an electronic lens in an in-line configuration and since the diameter of a neck portion of a funnel where the electron gun is mounted is limited, it is impossible to make the diameter of an electron beam passing hole larger than the distance between centers of two adjacent electron beam passing holes (to be referred to as "an eccentric distance" hereinafter).

An electrode unit for improving spherical aberration of the conventional main lens is disclosed in U.S. Pat. No. 4,370,592, which is shown in FIG. 1.

As shown in the drawing, burring portions 5*b* and 6*b* are formed at edges of a light emitting surface 5*a* of a focusing electrode 5 and a light receiving surface 6*a* of a final accelerating electrode 6, and large-diameter electron beam passing holes 5H and 6H having a predetermined depth are formed in the center thereof. Also, R, G and B small-diameter electron beam passing holes 5H' and 6H' through which R, G and B electron beams pass independently are formed in the large-diameter electron beam passing holes 5H and 6H.

When electron beams pass through the main lens constructed of the focusing electrode 5 and the final accelerating electrode 6, since the large-diameter electron beam passing holes 5H and 6H are non-circular, vertical and horizontal focusing components of the electron beams having passed through the small-diameter electron beam passing holes 5H' and 6H' in the center and the large-diameter electron beam passing holes 5H and 6H on both sides are different from each other. Thus, it is not possible to form uniform electron beam spots landing on the fluorescent surface. In other words, as shown in FIG. 2, the side electron beams RB and BB having passed through the large-diameter electron beam passing holes 5H and 6H of the focusing electrode 5 or the final accelerating electrode 6 are close to the burring portions 5*b* and 6*b* where a low voltage or a high voltage is horizontally distributed, and the central electron beam GB is relatively far from the burring portions 5*b* and 6*b*. Therefore, the side electron beams RB and BB are relatively strongly focused and the central electron beam GB is relatively weakly focused.

Also, since the distances between the side electron beams RB and BB and the burring portions 5*b* and 6*b* are different depending on the direction, the horizontal and vertical focusing forces for the side electron beams RB and BB are different from each other. Also, since the vertical distance between the central electron beam GB and the burring portions 5*b* and 6*b* is shorter than the horizontal distance therebetween, the central electron beam GB is applied to a focusing force which is strong in a vertical direction. Also, the central electron beam GB is applied to a divergent force in a diagonal direction of the large-diameter electron beam passing holes 5H and 6H. Thus, the side electron beams RB and BB having passed through the main lens have substantially triangular cross-sections and the central electron beam GB has a radially protruding cross-section, so that uniform electron beam cross-sections cannot be obtained throughout the entire surface of the fluorescent layer.

In particular, since the sizes of the small-diameter electron beam passing holes 5H' and 6H' are restricted by the diameter of a neck portion, there is a limit in increasing the eccentric distance between the small-diameter electron beam passing holes 5H' and 6H'. Further, in order to reduce deflection current, the tendency is toward reduction in the diameter of a neck portion. Thus, the distance between the small-diameter electron beam passing holes 5H' and 6H' is reduced, which lowers spherical aberration and focusing characteristics.

An electrode unit of an electron gun for solving the above-described problem is disclosed in U.S. Pat. No. 5,414,323. As shown in FIG. 3, an electrode plate member 16 is disposed in the center of an outer electrode 11 having large-diameter electron beam passing holes, and a vertically elongated small-diameter electron beam passing hole 13 is formed in the center of the electrode plate member 16. Both side edge portions are recessed in a semi-elliptic shape so as to form side electron beam passing holes 14 and 15. According to this electrode unit, astigmatic aberration generated by the large-diameter electron beam passing hole can be eliminated by making the small-diameter electron beam vertically elongated. However, this electrode cannot easily compensate for 8-pole coma aberration of the central electron beam passing hole and for 6-pole coma aberration of side electron beam passing holes.

Another conventional large-diameter electrode unit is disclosed in U.S. Pat. No. 4,626,738. As shown in FIG. 4, this electrode includes an outer electrode 21 having a large-diameter electron beam passing hole, and an inner electrode 22 disposed within the outer electrode 21 and having polygonal small-diameter electron beam passing holes 22R, 22G and 22B. Here, aberration generated by the large-diameter electron beam passing hole can be corrected by the polygonal small-diameter electron beam passing holes 22R, 22G and 22B. However, it is not easy to fabricate the polygonal small-diameter electron beam passing holes 22R, 22G and 22B.

Another conventional large-diameter electrode unit is shown in FIG. 5, in which electron beam passing holes 32R, 32G and 32B of an inner electrode 31 are vertically elongated. However, it is difficult to fabricate an electron gun having this type of electrode due to the vertically elongated electron beam passing holes.

SUMMARY OF THE INVENTION

To solve the above problems, it is an objective of the present invention to provide an electrode of an electron gun for a color cathode ray tube which can easily correct aberration of an electronic lens formed by a large-diameter electron beam passing hole and improve focusing characteristics.

Accordingly, to achieve the above objective, there is provided an electrode unit of an electron gun for a cathode ray tube including an outer rim electrode having a large-diameter electron beam passing hole through which three electron beams pass, and an inner electrode installed within the outer rim electrode and having a central electron beam passing hole disposed at its center and side electron beam passing holes disposed at opposite sides of the central electron beam passing hole, the side electron beam passing holes having first and second curved portions in which the sides close to the central electron beam passing hole and the sides facing thereto have predetermined curvatures, and linear portions connecting the first and second curved portions, the vertical width and the horizontal width of the side electron beam passing holes being equal to each other.

In the present invention, a flange inwardly extending from the top end of the outer rim electrode to thus define the shape of the large-diameter electron beam passing hole is preferably formed. The first curved portions preferably have curvatures of an ellipse and the second curved portions have curvatures of a circle.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

An electron gun for a color cathode ray tube having an electrode unit according to an embodiment of the present invention includes a cathode, a control electrode and a screen electrode forming a triode, and a focusing electrode and a final accelerating electrode forming auxiliary and main lenses.

Figure 1:
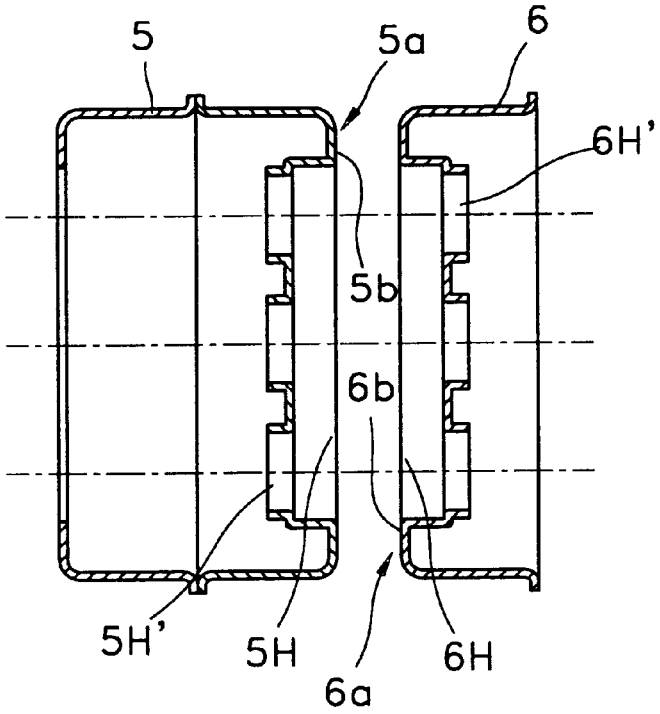
FIG. 1 (PRIOR ART)
FIG. 1 is a cross-sectional view of a conventional electrode unit of an electron gun.
Figure 2:
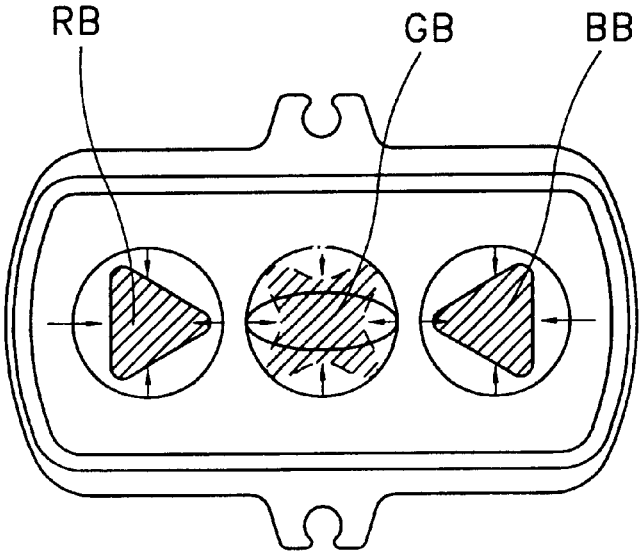
FIG. 2 (PRIOR ART)
FIG. 2 is a front view of the conventional electrode unit shown in FIG. 1, showing the cross sections of electron beams.
Figure 3:
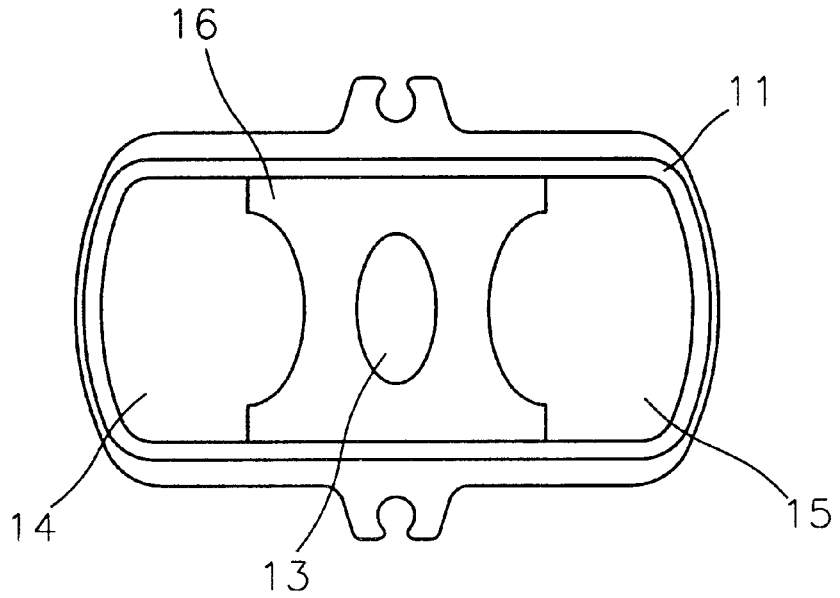
FIG. 3 (PRIOR ART)
FIGS. 3 through 5 are front views of another conventional electrode units.
Figure 4:
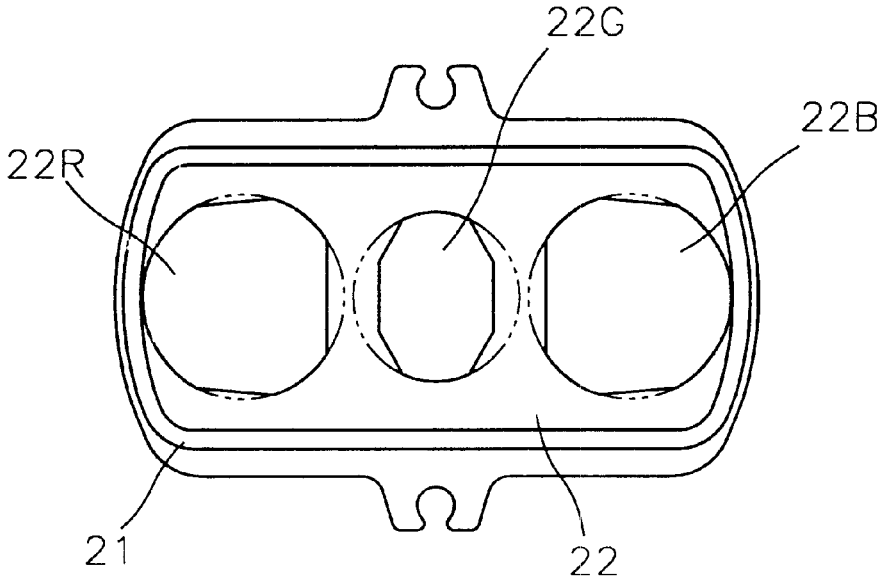
FIG. 4 (PRIOR ART)
Figure 5:
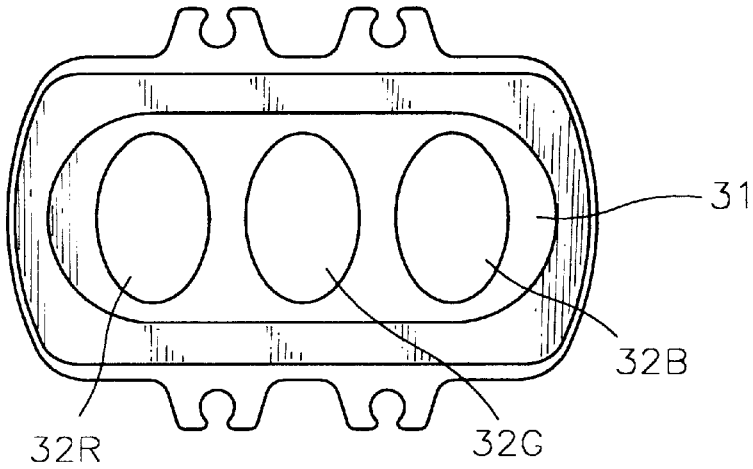
FIG. 5 (PRIOR ART)
Figure 6:
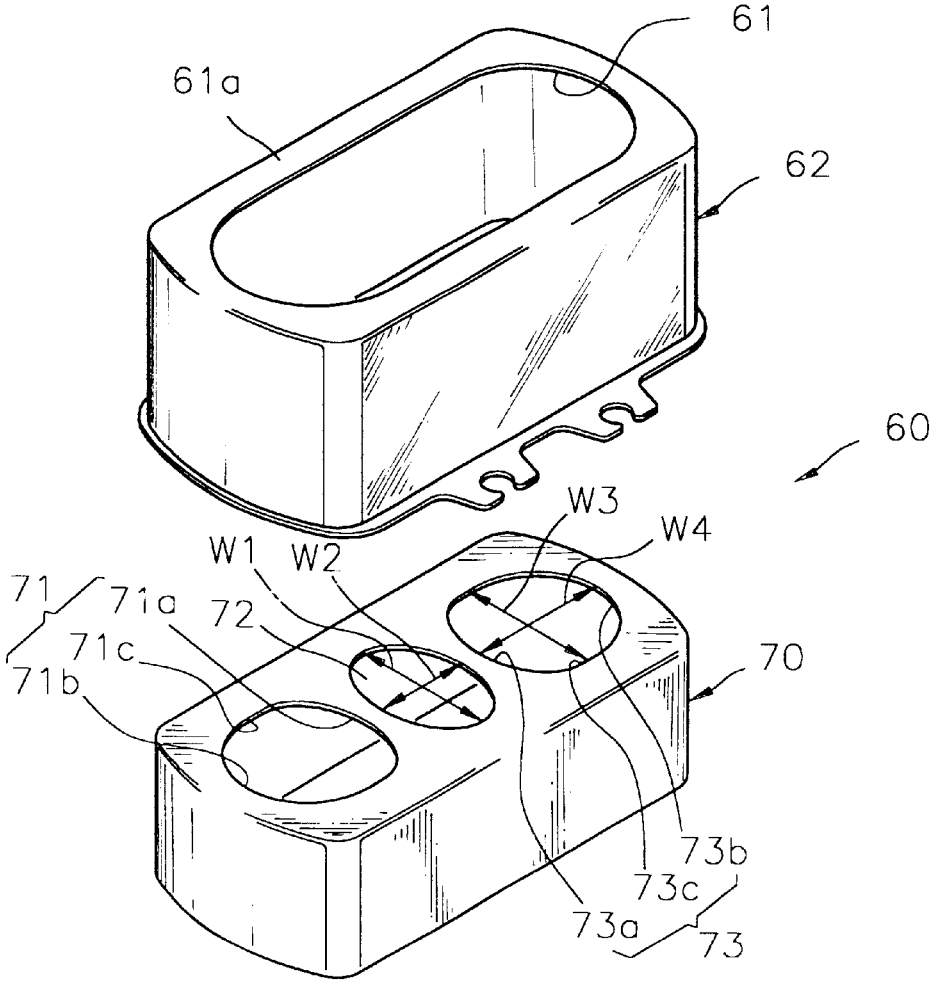
FIG. 6 is an exploded perspective view showing an electrode unit of an electron gun according to the present invention.
Figure 7:
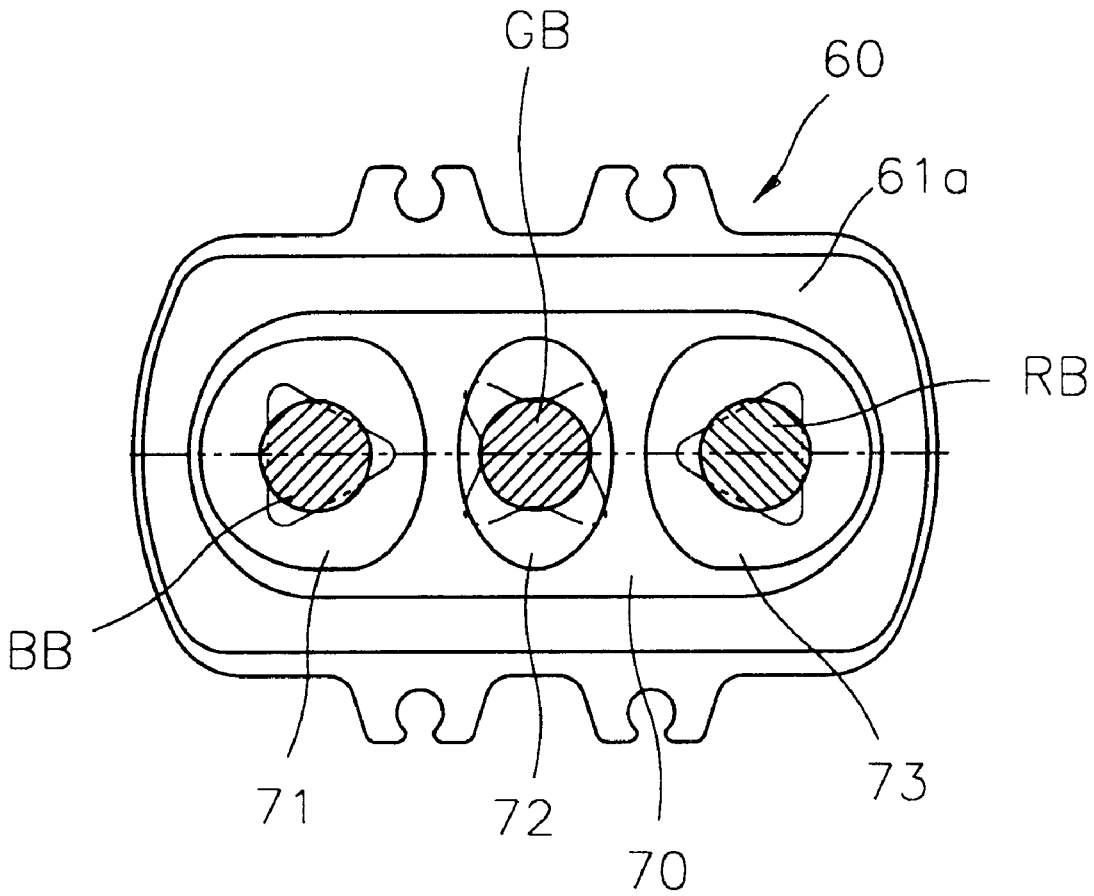
FIG. 7 is a front view of the electrode unit shown in FIG. 6, showing the cross sections of electron beams.

The structure of an electrode unit 60 of either a focusing electrode or a final accelerating electrode is shown in FIGS. 6 and 7, the focusing electrode and the final accelerating electrode forming a main lens. Referring to the drawings, the electrode unit 60 includes an outer rim electrode 62 having a large-diameter electron beam passing hole 61 formed at its center, and an inner electrode 70 installed to be spaced apart a predetermined distance from a flange 61*a* formed at the edge of the large-diameter electron beam passing hole 61 and having three independent electron beam passing holes 71, 72 and 73 formed in an in-line configuration. The shape of the large-diameter electron beam passing hole 61 formed on the outer rim electrode 62 is defined by the flange 61*a* inwardly extending from the top end of the outer rim electrode 62.

The inner electrode 70 may be a plate-shaped electrode or a rim-shaped electrode. Among the electron beam passing holes 71, 72 and 73 formed in the inner electrode in an in-line configuration, the central electron beam passing hole 72 is vertically elongated. In other words, the vertical width W1 of the central electron beam passing hole 72 is greater than the horizontal width W2. Here, the central electron beam passing hole 72 may be circular. Although not shown, of the two electrodes forming an electronic lens, an electrode positioned at a cathode side is preferably vertically elongated and an electrode positioned at a screen side is preferably circular.

The inner circumferential surfaces of the side electron beam passing holes 71 and 73 positioned at both sides of the central electron beam passing hole 72 have first curved portions 71*a* and 73*a* having a curvature of a part of an ellipse at the sides close to the central electron beam passing hole 72, second curved portions 71*b* and 73*b* having a curvature of a semi-circle at opposite sides of the first curved portions 71*a* and 73, and linear portions 71*c* and 73*c* which connect the first and second curved portions 71*a* and 73*a* and 71*b* and 73*b*. Here, the curvatures of the first curved portions 71*a* and 73*a* of the side electron beam passing holes 71 and 73 are preferably the same as the curvature of a part of an ellipse. Also, the second curved portions 71*b* and 73*b* are semi-circular. The vertical width W3 and the horizontal width W4 of the side electron beam passing holes 71 and 73 are equal to each other.

The curvatures of upper and lower portions of the first curved portions 71*a* and 73*a* of the side electron beam passing holes 71*a* nd 73 are appropriately set according to the degree of aberration. The first curved portions 71*a* and 73*a* may have two curvatures. In other words, in order to correct a difference in focusing force and divergent force due to the electrical field acting in a lengthwise direction of the large-diameter electron beam passing hole 61, the curvatures of the upper and lower portions of the first curved portions 71*a* and 73*a*.

In the operation of the above-described electrode unit of an electron gun according to the present invention, a predetermined voltage is applied to electrodes for forming an electronic lens.

Then, equipotential lines are formed in a normal direction of an electric force line formed between the electrodes, thereby forming an electronic lens, and electron beams pass through the electronic lens. Here, as described above, since the large-diameter electron beam passing hole 61 is non-circular, vertical and horizontal focusing components of the electron beams having passed through the small-diameter electron beam passing hole 72 in the center and the large-diameter electron beam passing holes 71 and 73 in both sides are different from each other. Thus, the electron beams are applied to different focusing forcing and divergent forces. In other words, since the horizontal distance and the diagonal distance of the flange 61*a* in which a low voltage and a high voltage are distributed are relatively long, the central electron beam and the side electron beams having passed through the large-diameter electron beam passing hole 61 are applied to a strong divergent force horizontally and diagonally. To correct this problem, the central electron beam passing hole 72 of the inner electrode 70 is made to be vertically elongated and the side electron beam passing holes 71 and 73 of the inner electrode 70 have first curved portions 71*a* and 73*a* having a curvature of a part of an ellipse at sides close to the central electron beam passing hole 72. In other words, the cross sections of the side electron beams BB and RB shown in FIG. 7 are corrected by changing the curvatures of the first curved portions 71*a* and 73*a* of the inner electrode 70. Also, since the second curved portions 71*b* and 73*b* have curvatures of a semi-circle, the cross sections of the side electron beams BB and RB can be made to be substantially circular. Thus, the cross sections of the electron beams RB, GB and BB having passed through the electronic lens are substantially circular, thereby obtaining a uniform shape of cross sections of electron beams throughout a fluorescent surface (not shown).

In particular, in the above-described electrode unit of an electron gun, the first curved portions 71*a* and 73*a* and the second curved portions 71*b* and 73*b* of the side electron beam passing holes 71 and 73 are connected via the linear portions 71*c* and 73*c,* thereby preventing distortion of the distribution of the equipotential lines forming the electronic lens at the boundary therebetween.

According to the electrode unit of an electron gun for a color CRT of the present invention, aberration of electron beams caused by a large-diameter electron beam passing hole can be reduced. Also, the shape of a cross section of an electron beam can be changed in a desirable way. Further, since the shapes of the side electron beam passing holes are not complex and the curvatures of the second curved portions are semi-circular, the electrode unit according to the present invention can be easily assembled, thereby improving productivity.

Although the present invention has been described with reference to illustrative embodiments, these are only provided by way of example and various changes and modifications may be effected by one skilled in the art within the scope of the invention as defined in the appended claims.

What is claimed is:

1. An electrode unit of an electron gun for a cathode ray tube comprising:

an outer rim electrode having a large-diameter electron beam passing hole through which three electron beams pass; and an inner electrode installed within the outer rim electrode and having a central electron beam passing hole disposed at its center and side electron beam passing holes disposed at opposite sides of the central electron beam passing hole, the side electron beam passing holes having respective peripheries, each periphery including first and second curved portions having different curvatures, and first and second straight portions directly connecting opposite ends of the first and second curved portions to each other, wherein side of the side electron beam passing holes closest to the central electron beam passing hole are curved, and sides of the side electron beam passing holes opposite the sides closest to the central electron beam passing hole are curved, and vertical and horizontal dimensions of the side electron beam passing holes are identical to each other.

2. The electrode unit according to claim 1, including a flange inwardly extending from an end of the outer rim electrode defining the large-diameter electron beam passing hole.

3. The electrode unit according to claim 1, wherein the first curved portions have curvatures that are parts of ellipses and the second curved portions have curvatures that are parts of circles.

4. The electrode unit according to claim 1, wherein the central electron beam passing hole is circular.

5. The electrode unit according to claim 3, wherein the central electron beam passing hole is circular.

6. The electrode unit according to claim 1, wherein the central electron beam passing hole is vertically elongated.

7. The electrode unit according to claim 3, wherein the central electron beam passing hole is vertically elongated.

* * * * *